US005984490A

United States Patent [19]

Leen

[11] Patent Number: 5,984,490

[45] Date of Patent: Nov. 16, 1999

[54] PORTABLE, DOUBLE-BULB HALOGEN WORK LIGHT/FLOODLIGHT

[76] Inventor: Monte A. Leen, 1804 W. Lake Sammamish Pkwy. NE., Bellevue, Wash. 98008

[21] Appl. No.: 08/728,660

[22] Filed: Oct. 10, 1996

[51] Int. Cl.[6] ..... F21S 3/12; F21V 7/12

[52] U.S. Cl. ..... 362/240; 362/223; 362/225; 362/247; 362/249; 362/368; 362/376; 362/400; 362/410

[58] Field of Search ..... 362/240, 241, 362/247, 248, 249, 263, 376, 399, 400, 410, 414, 432, 220, 223, 225, 368

[56] References Cited

U.S. PATENT DOCUMENTS

| | | | |
|---|---|---|---|
| 2,924,748 | 2/1960 | Carlson | 362/247 |
| 4,498,124 | 2/1985 | Mayer et al. | 362/247 |
| 4,719,545 | 1/1988 | Cano | 362/241 |
| 4,985,814 | 1/1991 | Lyons | 362/241 |
| 5,243,507 | 9/1993 | Atkins et al. | 362/376 |
| 5,473,523 | 12/1995 | Von Fange | 362/240 |
| 5,548,496 | 8/1996 | Hart et al. | 362/400 |
| 5,570,947 | 11/1996 | Felland | 362/225 |
| 5,580,156 | 12/1996 | Suzuki et al. | 362/240 |

*Primary Examiner*—Alan Cariaso
*Attorney, Agent, or Firm*—Christensen O'Connor Johnson & Kindness PLLC

[57] ABSTRACT

A portable, double-bulb halogen work light/floodlight (11) is disclosed. The portable, double-bulb halogen work light/floodlight includes an open-sided housing (17). Mounted in the housing is an undulating reflector (19) that includes at least two valleys in which halogen bulbs (21 and 23) are mounted. The open side of the housing is enclosed by a glass plate (25). Located on the outer face of the glass plate (25) is a grill (29). The base (15) includes a U-shaped base bracket (91) in which the housing (71) is mounted. Lock knobs (95) are used to lock the elevational position of the portable, double-bulb halogen work light/floodlight. Extending outwardly and downwardly from the cross-member (98) of the U-shaped bracket (91) are a plurality of feet (97). Affixed to the top of the housing (17) is a handle (81) surrounded by an insulating sleeve (83).

17 Claims, 2 Drawing Sheets

PORTABLE, DOUBLE-BULB HALOGEN WORK LIGHT/FLOODLIGHT

FIELD OF THE INVENTION

This invention relates to work lights and floodlights and, more particularly, to halogen work lights and floodlights.

BACKGROUND OF THE INVENTION

In recent years, a variety of types of high- and low-profile halogen work lights have been developed. High-profile halogen work lights include halogen lamps mounted on tripods and other elevation-raising mechanisms. Low-profile halogen work lights include halogen lamps supported by tubular frames formed of metal having a three-dimensional zigzag-like shape. Some low-profile halogen work lights combine halogen lamps with other elements, such as AC outlets, reels for extension cords, etc. The tubular frames of low-profile halogen work lights include tubular sections shaped and positioned to lie in a common plane and define a base. The base is designed to be positioned atop a floor or other generally horizontal support surface. An elevation control and locking mechanism that allows the beam of the halogen lamp to be elevated to a desired position and clamped is also usually included in low-profile halogen work lights.

In contrast to halogen work lights, in the past halogen floodlights have generally been large halogen lamps designed for mounting on poles, the side of a building, etc., for lighting a large, fixed location, such as a work yard, parking lot, etc. While halogen work lights can function as portable floodlights, in some environments they have been less powerful than desired. In this regard, halogen work lights normally include halogen bulbs falling in the 150–500 watt range. Halogen floodlights often include 500-watt halogen bulbs. 500-watt lights are sometimes too bright to be used by workers and others who require a nearby light source. One approach to resolving this problem is to include two (or more) lower-watt halogen lamps mounted on a single support structure, such as a telescoping tripod. While useful in some situations, this solution has some disadvantages in other situations. Further, it is more expensive and cumbersome than desired in many instances.

Thus, a need exists for a portable halogen light that can function both as a lower power halogen work light and as a more powerful halogen utility light or floodlight. This invention is directed to fulfilling this need.

SUMMARY OF THE INVENTION

In accordance with this invention, a portable halogen work light/floodlight is provided. The portable halogen work light/floodlight includes an open-sided housing in which at least two halogen bulbs are located. The halogen bulbs are located in the valley formed by reflector. Switches equal in number to the number of bulbs are provided for controlling the application of electrical power to the bulbs.

In accordance with additional aspects of this invention, the reflector has an undulating shape that defines two valleys. The halogen bulbs are located in the valleys formed by the undulating reflector.

In accordance with other aspects of this invention, the open side of the housing is enclosed by a glass lens whose outer face is protected by a grill.

In accordance with further aspects of this invention, the portable halogen work light/floodlight includes a base having an upwardly extending U-shaped bracket. The open-sided housing is mounted for rotation about a horizontal axis between the upwardly protruding legs of the U-shaped bracket.

In accordance with still other aspects of this invention, the base includes a plurality of legs that protrude downwardly and outwardly from the center of the bottom of the cross-leg of said U-shaped bracket.

In accordance with yet other aspects of this invention, an insulated handle is affixed to the top of the open-sided housing.

As will be readily appreciated from the foregoing description, the present invention provides a portable halogen work light/floodlight. The use of two bulbs allows the portable halogen work light/floodlight to be used as a low- or high-light output work light or a high-light output floodlight.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
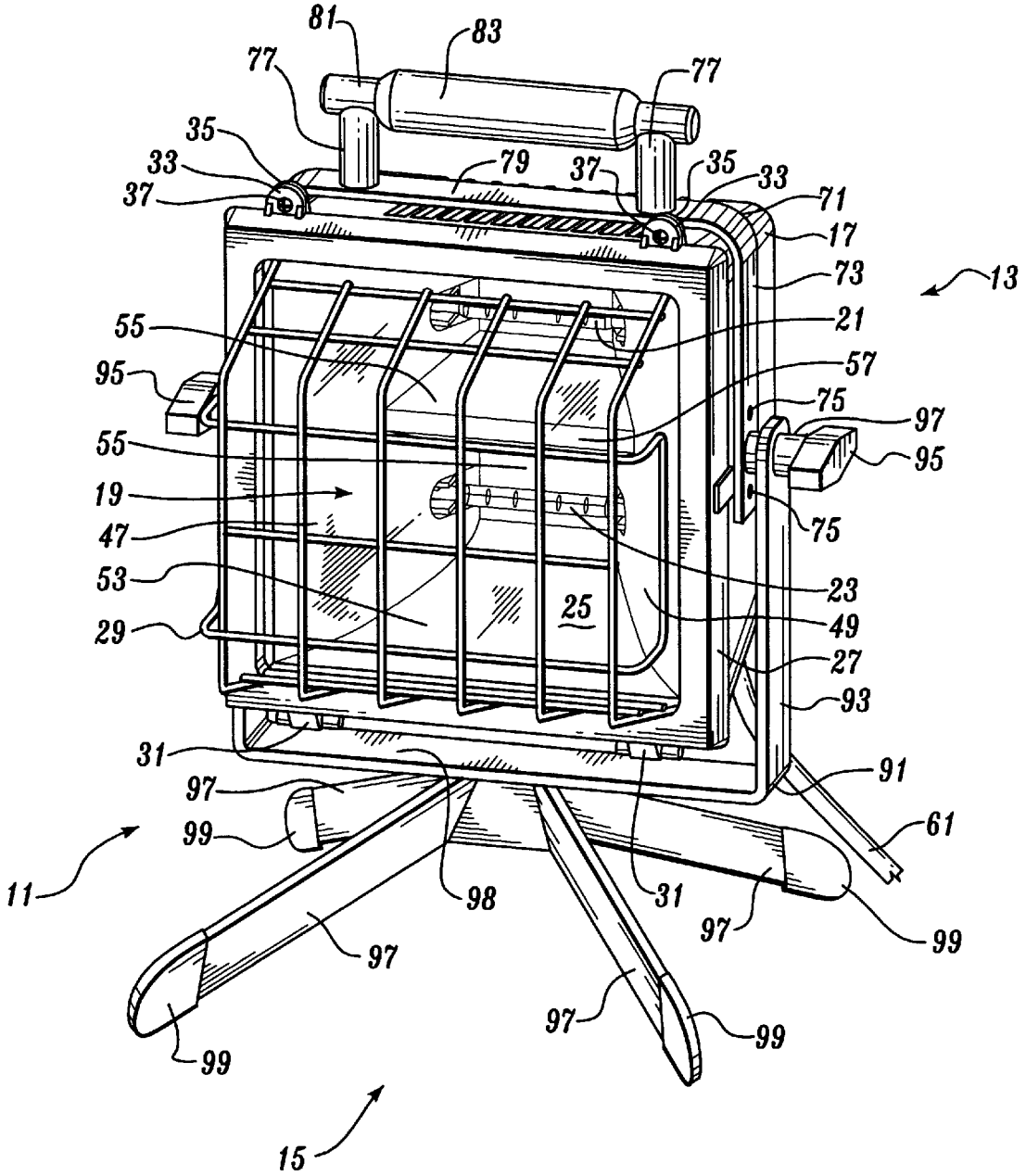
FIG. 1 is an isometric view of a portable, dual-bulb halogen work light/floodlight formed in accordance with this invention.
Figure 2:
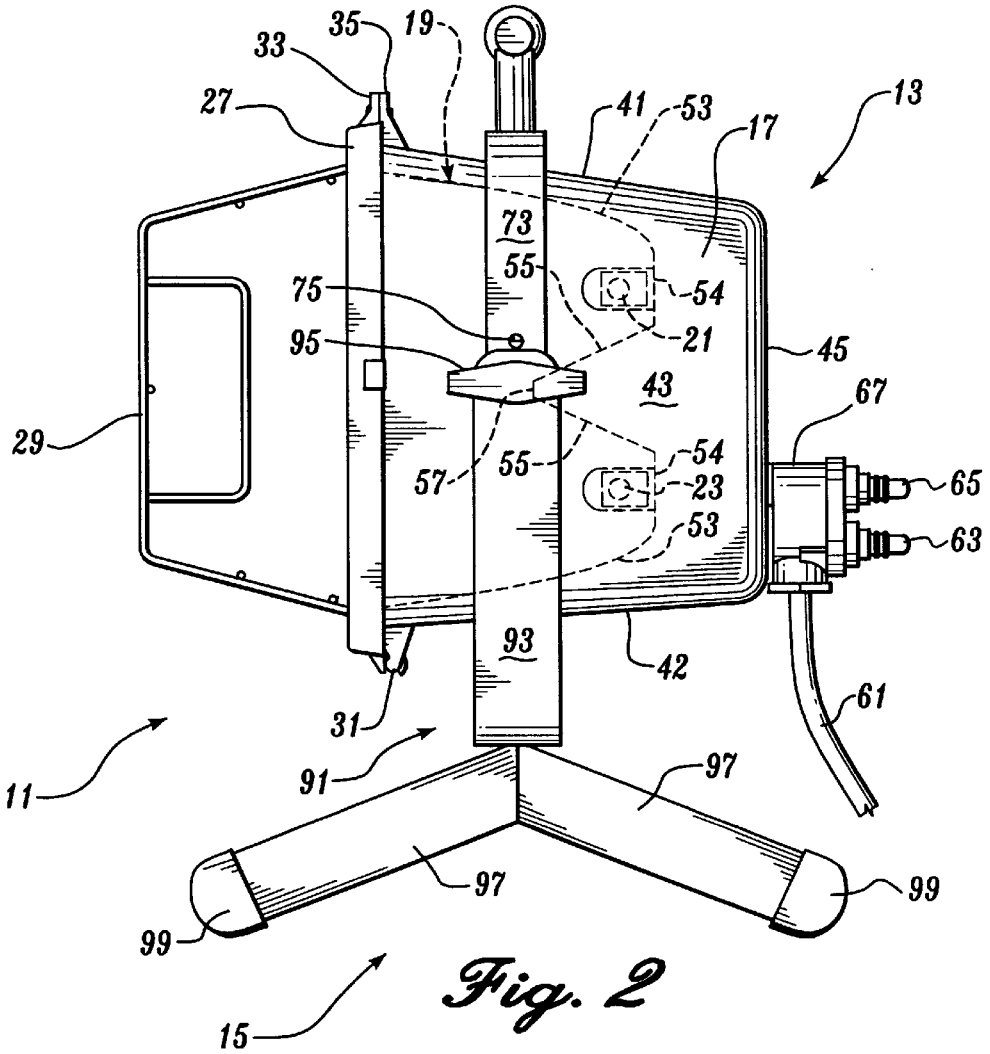
FIG. 2 is a side elevational view of the embodiment of the invention shown in FIG. 1, with the reflector and bulbs shown in phantom.

FIGS. 1 and 2 illustrate a portable, dual-bulb halogen work light/floodlight 11 formed in accordance with the invention. The portable, dual-bulb halogen work light/floodlight 11 includes a halogen lamp 13 and a base 15. The halogen lamp 13 includes an open-sided housing 17 formed of metal, such as aluminum. The halogen lamp 13 also includes a reflector 19 mounted in the housing and two elongate halogen bulbs 21 and 23. The opening in the housing 17, which is generally vertically oriented and has a generally square shape, is enclosed by a glass lens 25 that is held in place by a frame 27. The frame 27 supports a protective grill 29 formed of a plurality of wires. Alternatively, the grill and frame may be cast as a single unit. In any event, the grill provides a protective shield in front of the glass lens 25. The frame is hinged at the bottom by a pair of hinges 31 and includes two upwardly protruding flanges 33 that align with upwardly protruding flanges 35 formed in the top of the open-sided housing 17. Bolts 37 that thread into holes in the housing flanges hold the frame 27 in place with respect to the open-sided housing 17.

The top, bottom, and side walls 41, 42, and 43 of the housing 17 taper slightly inwardly, terminating at an integral rear wall 45. The reflector 19 includes a pair of generally vertical side sections 47 and 49 that flare inwardly, toward one another, from the outer edges of the side walls 43. Preferably, the reflector 19 also includes an undulating center section 51 that extends between the top and bottom walls of the housing 17. More specifically, as shown in phantom in FIG. 2, starting at the outer edges of the top and bottom walls of the open side of the housing 17, the undulating center 51 section flares 53 inwardly to the bottom of two valleys. After a short, flat region 54, the bottoms of the valleys taper outwardly 55, toward the horizontal center of the opening, terminating at a generally vertical plateau 57. The halogen bulbs 21 and 23 are located at the bottoms of the valleys, adjacent to the flat regions 54. Alternatively, the undulating portion of the reflector can be replaced with a single valley reflector, which may have a flat bottom, if desired.

Figure 3:
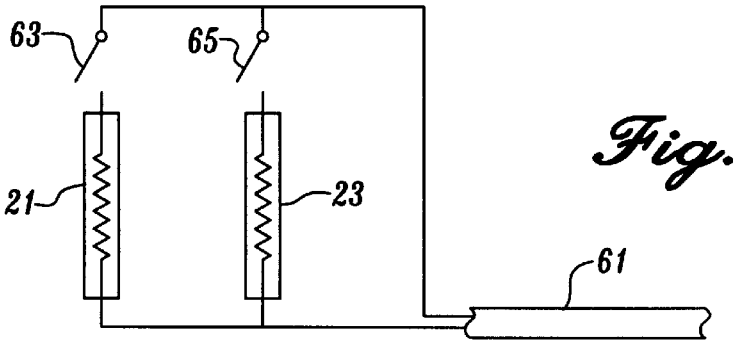
FIG. 3 is an electrical schematic diagram of the embodiment of the invention shown in FIGS. 1 and 2.

Electric power is supplied to the two halogen bulbs 21 and 23 by a conventional power cord 61. Two switches 63 and 65 mounted in a housing 67 attached to the rear wall 45 of the housing 17 control the flow of current to the halogen bulbs. That is, one switch controls the flow of current to one bulb and the other controls the flow of current to the other bulb, as shown in FIG. 3.

The halogen lamp 13 also includes a vertically oriented U-shaped handle bracket 71 sized to pass above and extend down approximately one-half of the height of the side walls 43. The downwardly extending legs 73 of the U-shaped handle bracket 71 are rigidly attached to the side walls 43 of the housing 17 by any suitable attachment medium, such as screws 75. A pair of spaced-apart spacers 77 are attached to and protrude upwardly from the cross-leg 79 of the bracket 71. A handle 81 extends between the outer ends of the spacers 77. Preferably, the portion of the handle 81 located between the spacers 77 is surrounded by a sleeve 83 formed of thermally insulating material, i.e., formed by a low heat insulating material, such as plastic.

The base 15 includes a U-shaped base bracket 91. The legs 93 of the U-shaped base bracket 91 protrude upwardly and are spaced apart by an amount slightly greater than the space between the legs 73 of the U-shaped handle bracket 71. A pair of bolts having T-shaped knobs 95 located on their outer ends extend through holes (not shown) in the upper ends of the U-shaped base bracket 91. The bolts pass through spacers 97 located between the legs 73 of the U-shaped handle bracket and the legs 93 of the U-shaped base bracket. The bolts are threaded into threaded holes located in the ends of the legs 73 of the U-shaped handle bracket 71. In a conventional manner tightening the bolts prevents the housing from rotating about a horizontal axis defined by the bolts. Loosening the bolts allows the housing 13 to be rotated about the horizontal axis into different elevational positions. Tightening the bolts after positioning the housing locks the housing and, thus, the light elevation at a desired elevational position.

The base 15 also includes a plurality of legs that are affixed to and extend downwardly and outwardly from the center of the bottom of the cross-member 98 of the U-shaped base bracket 91. The outer tips of the legs 97 are enclosed by covers 99. The covers are formed of a material, such as a soft plastic, designed to prevent scratching and marring of the surfaces on which the portable, dual-bulb halogen work light/floodlight 11 is placed.

As will be readily appreciated from the foregoing description and viewing FIGS. 1–3, a portable, dual-bulb halogen work light/floodlight formed in accordance with the invention can be used as a low- or high-intensity work light or floodlight, depending upon whether one or both of the switches 63 and 65 are closed. The elevation of the light is controlled by loosening the T-shaped knobs 95, adjusting the elevation of the light, and tightening the knobs.

While the implementation of the invention in one type of halogen work light has been illustrated and described, it will be appreciated that the invention can be used with other types of halogen work lights. Further, more than two bulbs and switches can be employed, if desired. Also, as an alternative to being supported by a base, the open-sided housing could be affixed to a permanent support structure, such as the side of a building or pole. Further, bases other than one including a U-shaped bracket can be used to support the open-sided housing. Thus, within the scope of the appended claims, it is to be understood that the invention can be practiced otherwise than as specifically described herein.

The embodiments of the invention in which an exclusive property or privilege is claimed are defined as follows:

1. A portable, multiple-bulb halogen work light/floodlight comprising:

a base;

a housing mounted on said base said housing having an open side;

a reflector having an undulating shape that defines two, and only two elongate valleys said two elongate valleys lying parallel to one another and mounted in said housing such that each valley reflects light outwardly through the open side of said housing said two elongate valleys joining one another along a common termination that lies inside of said housing substantially inwardly of the open side of said housing;

two, and only two, elongate halogen bulbs, one of said elongate halogen bulbs mounted in each of said elongate valleys of said reflector in longitudinal alignment with the valley in which said elongate halogen bulb is mounted; and a switch circuit for selectively controlling the application of electrical power to said two halogen bulbs.

2. The portable, multiple-bulb halogen work light/floodlight as claimed in claim 1, wherein the open side of said housing is enclosed by a glass lens.

3. A portable, multiple-bulb halogen work light/floodlight as claimed in claim 2, including a grill located on the face of said glass lens opposite the open side of said housing.

4. A portable, double-bulb halogen work light/floodlight as claimed in claim 1, wherein said base includes a U-shaped bracket having a pair of upwardly protruding legs and wherein said housing is mounted between the upwardly protruding legs of said U-shaped bracket.

5. The portable, multiple-bulb halogen work light/floodlight claimed in claim 4, wherein the open side of said housing is enclosed by a glass lens.

6. A portable, multiple-bulb halogen work light/floodlight as claimed in claim 5, including a grill located on the face of said glass lens opposite the open side of said housing.

7. A portable, multiple-bulb halogen work light/floodlight as claimed in claim 4, wherein said U-shaped bracket includes a cross-member and said base also includes a plurality of legs, said plurality of legs affixed to and extending downwardly and outwardly from the center of the cross-member of said U-shaped bracket.

8. The portable, multiple-bulb halogen work light/floodlight claimed in claim 7, wherein the open side of said housing is enclosed by a glass lens.

9. A portable, multiple-bulb halogen work light/floodlight as claimed in claim 8, including a grill located on the face of said glass lens opposite the open side of said housing.

10. A portable, multiple-bulb halogen work light/floodlight as claimed in claim 7, including a handle mounted on top of said housing.

11. The portable, multiple-bulb halogen work light/floodlight claimed in claim 10, wherein the open side of said housing is enclosed by a glass lens.

12. A portable, multiple-bulb halogen work light/floodlight as claimed in claim 11, including a grill located on the face of said glass lens opposite the open side of said housing.

13. A portable, multiple-bulb halogen work light/floodlight as claimed in claim 1, including a handle mounted on top of said housing.

14. The portable, multiple-bulb halogen work light/floodlight claimed in claim 13, wherein the open side of said housing is enclosed by a glass lens.

15. A portable, multiple-bulb halogen work light/floodlight as claimed in claim 14, including a grill located on the face of said glass lens opposite the open side of said housing.

16. A multiple-bulb halogen floodlight comprising:

a housing, said housing having an open side;

a reflector having an undulating shape that defines two and only two, elongate valleys, said two elongate valleys lying parallel to one another and mounted in said housing such that each valley reflects light outwardly through the open side of said housing said two elongate valleys joining one another along a common termination that lies inside of said housing substantially inwardly of the open side of said housing; and two and only two, elongate halogen bulbs, one of said elongate halogen bulbs mounted in each valley of said undulating reflector in longitudinal alignment with the valley in which said elongate halogen bulb is mounted.

17. The multiple-bulb halogen floodlight as claimed in claim 16, wherein the open side of said housing is enclosed by a glass lens.

* * * * *